US006724380B2

(12) United States Patent
Lee

(10) Patent No.: US 6,724,380 B2
(45) Date of Patent: Apr. 20, 2004

(54) CONTRAST CONTROL CIRCUIT FOR DISPLAY APPARATUS

(75) Inventor: Choong-ho Lee, Pusan (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 366 days.

(21) Appl. No.: 09/842,664

(22) Filed: Apr. 27, 2001

(65) Prior Publication Data

US 2001/0035864 A1 Nov. 1, 2001

(30) Foreign Application Priority Data

Apr. 28, 2000 (KR) ..... 2000-22758

(51) Int. Cl.[7] ..... G09G 5/00
(52) U.S. Cl. ..... 345/211; 345/204
(58) Field of Search ..... 345/211, 82, 89; 348/673; 323/282; 330/260

(56) References Cited

U.S. PATENT DOCUMENTS 3,649,847 A * 3/1972 Limberg ..... 327/308
3,851,094 A * 11/1974 Sasabe et al. ..... 348/110
3,914,545 A * 10/1975 Engel ..... 348/673
5,049,834 A * 9/1991 Kasai ..... 330/255
5,250,937 A * 10/1993 Kikuo et al. ..... 345/89
5,724,519 A * 3/1998 Kato et al. ..... 345/204
5,966,110 A * 10/1999 Van Zalinge ..... 345/82

* cited by examiner

*Primary Examiner*—Amare Mengistu
*Assistant Examiner*—Prabodh M. Dharia
(74) *Attorney, Agent, or Firm*—Leydig, Voit & Mayer, Ltd.

(57) ABSTRACT

A contrast control circuit for a display apparatus includes first and second resistors, a first transistor, a second transistor, and a Darlington circuit. The first and second resistors, each have a first end connected to a positive supply voltage. The first transistor has an emitter connected to a second end of the first resistor and a base to which the first voltage is input. The second transistor has an emitter connected to the second end of the first resistor, a base connected to the second end of the second resistor, and a collector connected to a negative supply voltage. The Darlington circuit is connected between the second voltage, the collector of the first transistor, and the negative supply voltage, and operates such that the absolute value of the second voltage is inversely proportional to the absolute value of the first voltage.

4 Claims, 4 Drawing Sheets

CONTRAST CONTROL CIRCUIT FOR DISPLAY APPARATUS

BACKGROUND OF THE INVENTION

1. Field of the Invention

The present invention relates to a contrast control circuit for a display apparatus, and more particularly, to a contrast control circuit for a display apparatus, which receives a first voltage of positive polarity adjusted by a user, and outputs a second voltage of negative polarity for controlling the contrast of a liquid crystal display panel.

2. Description of the Related Art

Referring to FIG. 1, a liquid crystal display apparatus 1, which is one of general display apparatuses, includes a liquid crystal display panel 11 and a driving apparatus thereof.

In the liquid crystal display panel 11, signal electrode lines SL1, SL2, . . . , SLm are parallel arranged on cells of liquid crystal (LC), and scan electrode lines CL1, CL2, . . . , CLn are parallel arranged under the LC cells to be orthogonal to the signal electrode lines SL1, SL2, . . . , SLm. The scan electrode lines CL1, CL2, . . . , CLn and the signal electrode lines SL1, SL2, . . . , SLm are made of a transparent conductive material, for example, ITO (indium tin oxide).

The driving apparatus includes a controller 14, a segment driver 12, a modulation-signal generator 141 and a common driver 13. The controller 14 processes a video signal Sc from a host computer, e.g., a notebook computer, and generates a data signal DATA, a shift clock signal SCK, a frame signal FLM and a latch clock signal LCK.

The segment driver 12 makes the input data signal DATA stand by in the respective signal electrode lines SL1, SL2, . . . , SLm according to the shift clock signal SCK. Also, a signal voltage corresponding to the data signal DATA standing by according to the latch clock signal, is applied to the respective signal electrode lines SL1, SL2, . . . , SLm. Here, a circuit of generating bias voltages VBS supplied to the segment driver 12 is shown in FIG. 2.

The frame signal FLM indicates starting of a frame. The modulation-signal generator 141 divides the frequency of the latch clock signal LCK and generates a modulation signal. The generated modulation signal controls the polarity of voltages output from the segment driver 12 and the common driver 13.

The common driver sequentially applies the corresponding scan voltages to the respective scan electrode lines CL1, CL2, . . . , CLn by controlling the latch clock signal LCK, the frame signal FLM and the modulation signal. Accordingly, the arrangement of liquid crystal (LC) of a to-be-displayed cell changes and light is transmitted or blocked. Here, a circuit of generating bias voltages VBC supplied to the common driver 12 is shown in FIG. 2.

Referring to FIG. 2, the circuit of generating bias voltages applied to the common driver (13 of FIG. 1) and the segment driver (12 of FIG. 2), includes a contrast control circuit 151 and a bias-voltage generator 15. The contrast control circuit 151 receives a first voltage of positive polarity adjusted by a user and outputs a second voltage VOUT of negative polarity for controlling the contrast of a liquid crystal display panel. The bias-voltage generator 15 produces bias voltages VBC and VBS applied to the common driver 13 and the segment driver 12 according to the output voltage VOUT of the contrast control circuit 151.

FIG. 3 is a detailed circuit diagram of the contrast control circuit 151 of the conventional liquid crystal display apparatus.

Referring to FIG. 3, the positive voltage applied to an input port 2 of an operation amplifier (OP-AMP) is determined by a positive supply voltage VCC and eighth, ninth and tenth resistors R8, R9 and R10. Reference symbol C represents a capacitor for removing radio frequency noise. The resistance of the ninth resistor R9 varies by user's manipulation. For example, the positive voltage applied to the input port 2 of the OP-AMP varies in the range from 0 to 3 V.

The OP-AMP operable by positive and negative supply voltages VCC and VEE, outputs a negative voltage VOUT, the absolute value of which is proportional to the positive voltage applied to the input port 2. The absolute value of the output voltage VOUT is proportional to the combined resistance value of eleventh, twelfth and thirteenth resistors R11, R12 and R13. The negative voltage VOUT output from the OP-AMP is applied to the bias-voltage generator (15 of FIG. 3) as a contrast controlling voltage. The rated contrast controlling voltage VOUT applied to the bias-voltage generator 15 ranges from −8 to −11 V, for example.

According to the aforementioned contrast control circuit for the conventional display apparatus, since an OP-AMP which is commercially available at high cost is necessarily used, the manufacturing cost increases. Also, circuit stability cannot be improved and power consumption increases.

SUMMARY OF THE INVENTION

To solve the above problems, it is an object of the present invention to provide a contrast control circuit for a display apparatus, which can reduce the manufacturing cost and power consumption and can improve circuit stability.

Accordingly, to achieve the above object, there is provided a contrast control circuit for a display apparatus, which receives a first voltage of positive polarity adjusted by a user, and outputs a second voltage of negative polarity for controlling the contrast of a display panel. The contrast control circuit includes third and fourth resistors, a first transistor, a second transistor, serially connected resistors and a Darlington circuit. The third and fourth resistors each have one end connected to the terminals of a positive supply voltage. The first transistor has its emitter connected to the other end of the third resistor and its base to which the first voltage is input. The second transistor has its emitter connected to the other end of the third resistor, its base connected to the other end of the fourth resistor, and its collector connected to a terminal of a negative supply voltage. The serially connected resistors have one end connected to the base of the second transistor and the other end connected to the output terminal of the second volt age. The Darlington circuit, constituents of which are connected between each of the output terminal of the second voltage, the collector of the first transistor and the terminal of the negative supply voltage, operates such that the absolute value of the second voltage is inversely proportional to the absolute value of the first voltage.

In the contrast control circuit for a display apparatus according to the present invention, the voltage of the base terminal of the second transistor is equal to the first voltage and the absolute value of the second voltage is inversely proportional to the absolute value of the first voltage. Accordingly, the second voltage can be generated by the first voltage, without using an operation amplifier which is commercially available at high cost. Thus, the manufacturing cost and power consumption can be reduced, and the circuit stability can be improved.

Preferably, at least one of the fourth resistor and the serially connected resistors is a thermistor. Accordingly, the circuit stability depending on temperature can be more effectively improved.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

Figure 1:
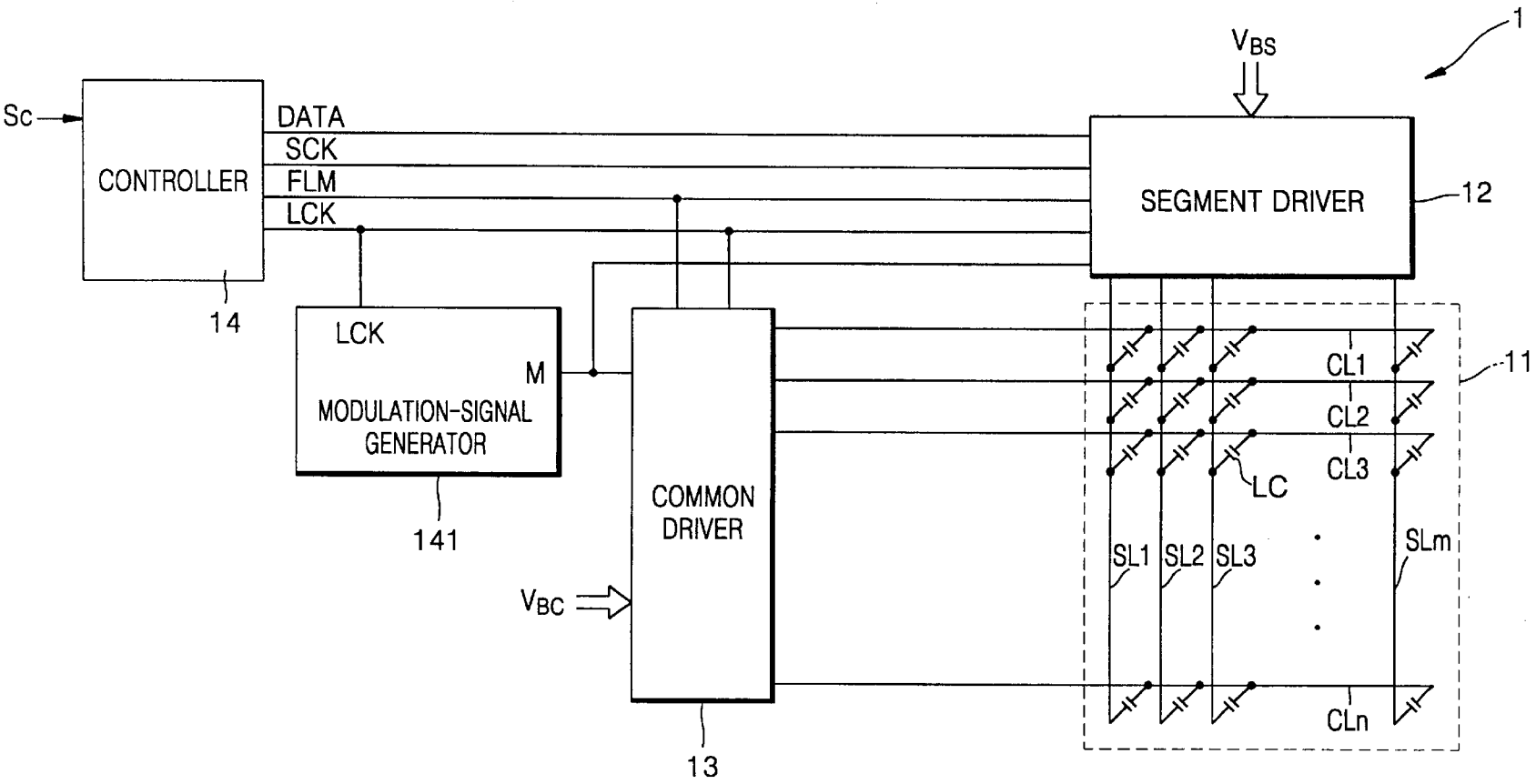
FIG. 1 (PRIOR ART)
FIG. 1 is a block diagram illustrating a conventional liquid crystal display apparatus.
Figure 2:
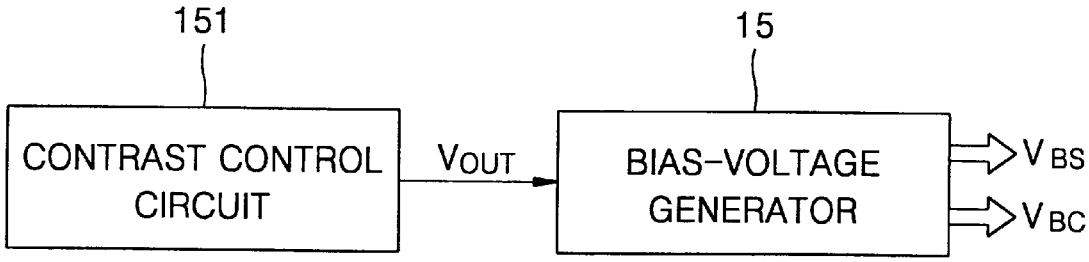
FIG. 2 (PRIOR ART)
FIG. 2 is a block diagram illustrating circuits of generating bias voltages applied to a common driver and a segment driver in the apparatus shown in FIG. 2.
Figure 3:
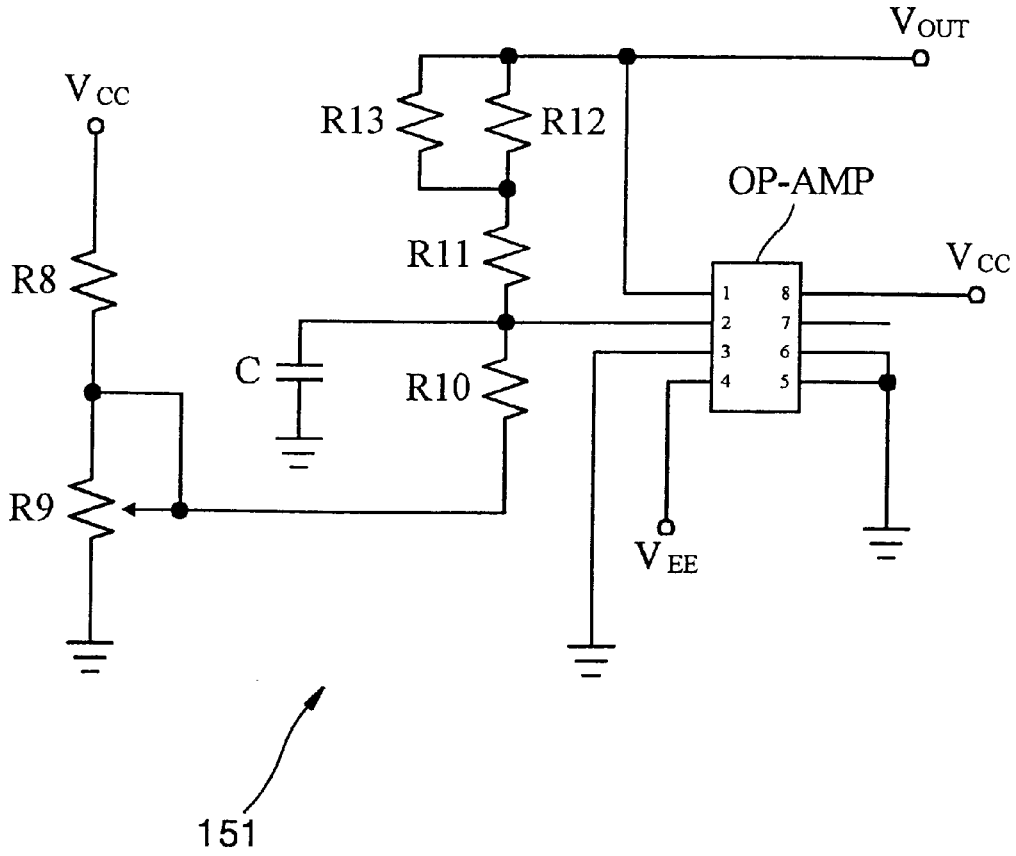
FIG. 3 (PRIOR ART)
FIG. 3 is a detailed circuit diagram illustrating a contrast control circuit for the conventional liquid crystal display apparatus.
Figure 4:
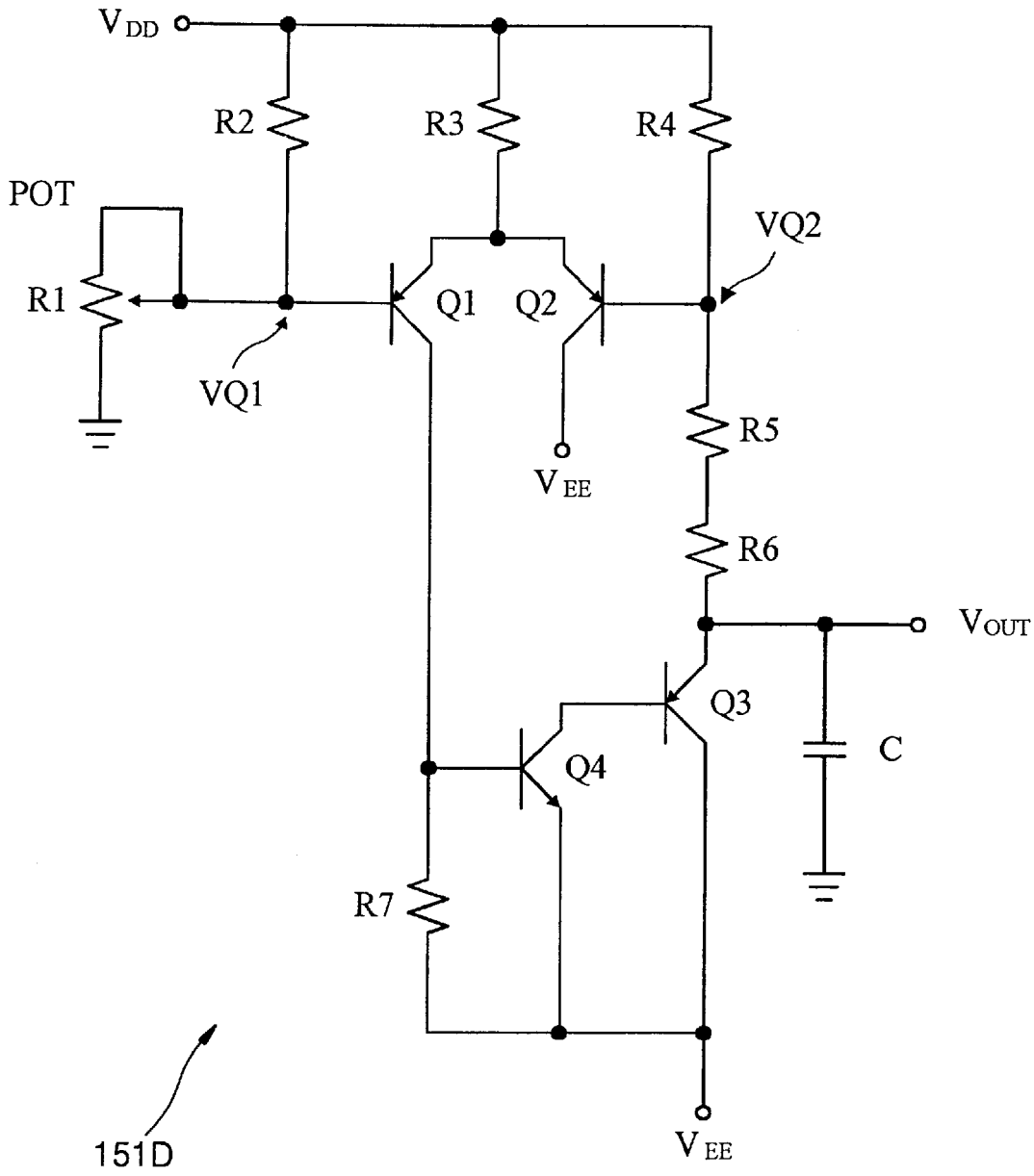
FIG. 4 is a detailed circuit diagram illustrating a contrast control circuit for a liquid crystal display apparatus according to an embodiment of the present invention.

Referring to FIG. 4 showing a contrast control circuit 151D for a liquid crystal display apparatus according to an embodiment of the present invention, the contrast control circuit receives a first voltage VQ1 of positive polarity adjusted by a user, and outputs a second voltage VOUT of negative polarity for controlling the contrast of a liquid crystal display panel.

The positive first voltage VQ1 is determined by a first resistance R1 and a second resistance R2 of a variable resistor (POT), e.g., a potentiometer.

One end of each of third and fourth resistors R3 and R4 is connected to the terminal of a positive supply voltage VDD. The emitter of a first transistor Q1 is connected to the other end of the third resistor R3 and the first voltage VQ1 is input to its base. The emitter of a second transistor Q2 is connected to the other end of the third resistor R3, its base is connected to the other end of the fourth resistor R4, and its is connected to a terminal of a negative supply voltage VEE. Serially connected resistors R5+R6 have one end connected to the base of the second transistor Q2 and the other end connected to the output terminal of the second voltage VOUT.

A Darlington circuit, constituted by Q3, Q4 and R7 which are connected between each of the output terminal of the second voltage VOUT, the collector of the first transistor Q1 and the terminal of the negative supply voltage VEE, operates such that the absolute value of the second voltage VOUT is inversely proportional to the absolute value of the first voltage VQ1.

Since the first voltage VQ1 of positive polarity is equal to the second voltage VQ2 of positive polarity, the following equation (1) is satisfied:

$$VQ1=VQ2 \tag{1}$$

wherein the first voltage VQ1 is established by the following equation (2):

$$VQ1=VDD*\{R1/(R1+R2)\} \tag{2}$$

Under the conditions of equations (1) and (2) as listed above, since little current flows through the base of the second transistor Q2, the current flowing in the fourth resistor R4 is substantially the same with that flowing through the emitter of the third transistor Q3. Accordingly, the following equation (3) is established:

$$(VDD-VQ2)/R4=(VQ2-VOUT)/(R5+R6) \tag{3}$$

which can be rewritten with respect to VQ2, to establish the following equation (4):

$$VQ2=\{VDD*(R5+R6)+VOUT*R4\}/(R4+R5+R6) \tag{4}$$

Based on the equations (2) and (3), the output voltage VOUT is determined by the following equation (5):

$$VOUT=-VDD*G+VQ2*(1+G) \tag{5}$$

wherein G denotes a value of (R5+R6)/R4. According to the equations 1 and 5, the absolute value of the output voltage VOUT for controlling negative polarity contrast is inversely proportional to the absolute value of the first voltage VQ1 of positive polarity, which may be a user's input voltage.

In the case where at least one of the fourth resistor R4 and the serially connected resistors R5+R6, is a thermistor, the output voltage VOUT compensated for a change in the temperature can be obtained, thereby more effectively improving the circuit stability.

As described above, in the contrast control circuit for a display apparatus according to the present invention, a desired voltage for controlling the contrast is output, without employing an operation amplifier commercially available at high cost, the manufacturing cost and power consumption can be reduced. Also, the circuit stability can be improved.

Although the invention has been described with respect to a preferred embodiment, it is not to be so limited as changes and modifications can be made which are within the full intended scope of the invention as defined by the appended claims.

What is claimed is:

1. A contrast control circuit for a display apparatus, which receives a first voltage of positive polarity adjusted by a user, and outputs a second voltage of negative polarity for controlling the contrast of a display panel, the contrast control circuit comprising:

an input terminal for receiving the first voltage and an output terminal at which the second voltage is produced by the contrast control circuit;

first and second resistors having respective first ends connected to a positive supply voltage;

a first transistor having an emitter connected to a second end of the first resistor, a base connected to the input terminal, and a collector;

a second transistor having an emitter connected to the second end of the first resistor, a base connected to a second end of the second resistor, and a collector connected to a negative supply voltage;

third and fourth serially connected resistors, the serially connected resistors having a first end connected to the base of the second transistor and a second end connected to the output terminal; and a Darlington circuit having an output connected to the output terminal and an input connected to the collector of the first transistor, the Darlington circuit being connected to the negative supply voltage, whereby the contrast control circuit operates such that absolute value of the second voltage is inversely proportional to absolute value of the first voltage.

2. The contrast control circuit according to claim 1, wherein at least one of the second resistor and the third and fourth serially connected resistors is a thermistor.

3. A display apparatus having a contrast control circuit which receives a first voltage of positive polarity adjusted by a user, and outputs a second voltage of negative polarity for controlling the contrast of a display panel, wherein the contrast control circuit comprises:

an input terminal for receiving the first voltage and an output terminal at which the second voltage is produced by the contrast control circuit;

first and second resistors having respective first ends connected to a positive supply voltage;

a first transistor having an emitter connected to a second end of the first resistor, a base connected to the input terminal, and a collector, a second transistor having an emitter connected to the second end of the first resistor, a base connected to a second end of the second resistor, and a collector connected to a negative supply voltage;

third and fourth serially connected resistors, the serially connected resistors having a first end connected to the base of the second transistor and a second end connected to the output terminal; and a Darlington circuit having an output connected to the output terminal and an input connected to the collector of the first transistor, the Darlington circuit being connected to the negative supply voltage, whereby the contrast control circuit operates such that absolute value of the second voltage is inversely proportional to absolute value of the first voltage.

4. A liquid crystal display apparatus having a contrast control circuit which receives a first voltage of positive polarity adjusted by a user, and outputs a second voltage of negative polarity for controlling the contrast of a liquid crystal display panel, wherein the contrast control circuit comprises:

an input terminal for receiving the first voltage and an output terminal at which the second voltage is produced by the contrast control circuit;

first and second resistors having respective first ends connected to a positive supply voltage;

a first transistor having an emitter connected to a second end of the first resistor, a base connected to the input terminal, and a collector;

a second transistor having an emitter connected to the second end of the first resistor, a base connected to a second end of the second resistor, and a collector connected to a negative supply voltage;

third and fourth serially connected resistors, the serially connected resistors having a first end connected to the base of the second transistor and a second end connected to the output terminal; and a Darlington circuit having an output connected to the output terminal and an input connected to the collector of the first transistor, the Darlington circuit being connected to the negative supply voltage, whereby the contrast control circuit operates such that absolute value of the second voltage is inversely proportional to absolute value of the first voltage.

* * * * *